US010411337B2

(12) United States Patent
Ikeda et al.

(10) Patent No.: US 10,411,337 B2
(45) Date of Patent: Sep. 10, 2019

(54) ANTENNA DEVICE

(71) Applicant: DENSO CORPORATION, Kariya, Aichi-pref. (JP)

(72) Inventors: Masakazu Ikeda, Nishio (JP); Hiroaki Kuraoka, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 183 days.

(21) Appl. No.: 15/526,016

(22) PCT Filed: Dec. 4, 2015

(86) PCT No.: PCT/JP2015/006039
§ 371 (c)(1),
(2) Date: May 11, 2017

(87) PCT Pub. No.: WO2016/092794
PCT Pub. Date: Jun. 16, 2016

(65) Prior Publication Data

US 2018/0301798 A1 Oct. 18, 2018

(30) Foreign Application Priority Data

Dec. 10, 2014 (JP) ..... 2014-250183

(51) Int. Cl.
*H01Q 1/48* (2006.01)
*H01Q 9/04* (2006.01)
(Continued)

(52) U.S. Cl.
CPC ..... *H01Q 1/48* (2013.01); *H01Q 5/364* (2015.01); *H01Q 5/385* (2015.01); *H01Q 9/0421* (2013.01); *H01Q 13/10* (2013.01)

(58) Field of Classification Search
CPC ..... H01Q 9/0421; H01Q 1/48; H01Q 5/364; H01Q 5/385; H01Q 13/10
See application file for complete search history.

(56) References Cited

U.S. PATENT DOCUMENTS 6,188,366 B1 2/2001 Yamamoto et al.
2004/0061652 A1* 4/2004 Ishihara ..... H01Q 9/0421 343/752
(Continued)

FOREIGN PATENT DOCUMENTS

JP H05226923 A 9/1993
JP 2000059129 A 2/2000
(Continued)

*Primary Examiner* — Daniel Munoz
(74) *Attorney, Agent, or Firm* — Harness, Dickey & Pierce, P.L.C.

(57) ABSTRACT

An antenna device includes a base plate, an opposing conductor plate, a short-circuiting portion, a power-feed point, and at least one second-frequency electric-field impeding element provided to the opposing conductor plate, the base plate, or between the opposing conductor plate and the base plate. The second-frequency electric-field impeding element impedes a propagation of an electric field being vertical to the base plate and heading from the short-circuiting portion toward an outer edge portion of the opposing conductor plate, is induced at a second frequency higher than the first frequency, does not impede a propagation of the electric field induced at the first frequency, and is disposed such that an electrical area of the opposing conductor plate for a signal at the second frequency is an area of a proper size to generate an electrostatic capacitance that undergoes parallel resonance with the inductance of the short-circuiting portion at the second frequency.

10 Claims, 15 Drawing Sheets

(51) Int. Cl.

| | |
|---|---|
| ***H01Q 13/10*** | (2006.01) |
| ***H01Q 5/364*** | (2015.01) |
| ***H01Q 5/385*** | (2015.01) |

(56) References Cited

U.S. PATENT DOCUMENTS

| | | | | |
|---|---|---|---|---|
| 2004/0164916 | A1 | 8/2004 | Jecko et al. | |
| 2012/0176208 | A1* | 7/2012 | Shirakawa | H01P 5/184 333/24 R |
| 2012/0299778 | A1* | 11/2012 | Yen | H01L 23/48 343/700 MS |

FOREIGN PATENT DOCUMENTS

| | | | | |
|---|---|---|---|---|
| JP | 2004531152 | A | 10/2004 | |
| JP | 2005033343 | A | 2/2005 | |
| JP | 4044895 | B2 | 2/2008 | |
| JP | 2011244136 | A | 12/2011 | |
| WO | WO-2005064745 | A1 * | 7/2005 | H01Q 1/32 |

* cited by examiner

ANTENNA DEVICE

CROSS REFERENCE TO RELATED APPLICATIONS

This application is a U.S. National Phase Application under 35 U.S.C. 371 of International Application No. PCT/JP2015/006039 filed on Dec. 4, 2015 and published in Japanese as WO 2016/092794 A1 on Jun. 16, 2016. This application is based on and claims the benefit of priority from Japanese Patent Application No. 2014-250183 filed on Dec. 10, 2014. The entire disclosures of all of the above applications are incorporated herein by reference.

TECHNICAL FIELD

The present disclosure relates to an antenna device including a metal conductor of a flat-plate shape functioning as a ground and another metal conductor of a flat-plate shape disposed oppositely to the firstly-mentioned metal conductor, and configured to transmit and receive radio waves at two or more target frequencies.

BACKGROUND ART

An antenna device in the related art disclosed in Patent Literature 1 includes a metal conductor of a flat-plate shape (base plate) functioning as a ground, another metal conductor of a flat-plate shape (opposing conductor plate) disposed oppositely to the base plate and provided with a power-feed point at an arbitrary position, and a short-circuiting portion electrically connecting the base plate and the opposing conductor plate.

The antenna device as above gives rise to parallel resonance using an electrostatic capacitance generated between the base plate and the opposing conductor plate and inductance of the short-circuiting portion at a frequency corresponding to the electrostatic capacitance and the inductance. An electrostatic capacitance generated between the base plate and the opposing conductor plate is determined by an area of the opposing conductor plate. Hence, by adjusting the area of the opposing conductor plate, a target frequency (operating frequency) for transmission and reception by the antenna device can be set to a desired frequency.

Patent Literature 1 discloses a configuration in which a single slot formed in a C-shape is provided to the opposing conductor plate to be parallel to an outer edge portion of the opposing conductor plate. The opposing conductor plate is thus divided to a region on an inner side of the slot and a region on an outer side of the slot.

The configuration as above can achieve two capacitive effects. One is a capacitive effect by the region of the opposing conductor plate on the outer side of the slot and the other is a capacitive effect by the region of the opposing conduction plate on the inner side of the slot. Consequently, the antenna device has two resonance frequencies corresponding to the respective regions. In order to achieve the capacitive effect by the inner region, the slot provided to the opposing conductor plate in Patent Literature 1 has a length with which the slot substantially forms most of a circumferential portion of the inner region.

PRIOR ART LITERATURES

Patent Literature

Patent Literature 1: JP4044895B2

SUMMARY OF INVENTION

According to the configuration of Patent Literature 1, the area of the opposing conductor plate is used by dividing the area to two segments by the slot. Hence, the entire opposing conductor plate has to be designed so as to provide the region on the outer side of the slot and the region on the inner side of the slot with areas corresponding to the respective frequencies. In short, the opposing conductor plate needs to have an area equal to a sum of the areas corresponding to two frequencies.

In view of the foregoing circumstances, the present disclosure has an object to provide a smaller antenna device capable of transmitting and receiving radio waves at two or more frequencies.

According to an aspect of the present disclosure, the antenna device includes a base plate, an opposing conductor plate that is a conductor member of a flat-plate shape provided parallel to the base plate at a predetermined interval, a short-circuiting portion provided to a center portion of the opposing conductor plate to electrically connect the opposing conductor plate and the base plate, a power-feed point electrically connecting the opposing conductor plate and an electrical supply line used to feed power to the opposing conductor plate, and at least one second-frequency electric-field impeding element provided to the opposing conductor plate, the base plate, or between the opposing conductor plate and the base plate. An area of the opposing conductor plate is an area of a proper size to generate an electrostatic capacitance that gives rise to parallel resonance with inductance of the short-circuiting portion at a predetermined first frequency. The second-frequency electric-field impeding element impedes a propagation of an electric field, which is vertical to the base plate and heads from the short-circuiting portion toward an outer edge portion of the opposing conductor plate, induced at a second frequency higher than the first frequency and does not impede a propagation of the electric field induced at the first frequency. The second-frequency electric-field impeding element is disposed so as to make an electrical area of the opposing conductor plate for a signal at the second frequency to be an area of a proper size to generate an electrostatic capacitance that undergoes parallel resonance with the inductance of the short-circuiting portion at the second frequency.

According to the configuration as above, an area of the opposing conductor plate is an area of a proper size to generate an electrostatic capacitance that undergoes parallel resonance with inductance of the short-circuiting portion at the first frequency. Hence, parallel resonance takes place at the first frequency due to exchange of energy between the inductance and the electrostatic capacitance and an electric field vertical to the base plate (and the opposing conductor plate) is induced between the base plate and the opposing conductor plate. The vertical electric field propagates from the short-circuiting portion toward the outer edge portion of the opposing conductor plate. The vertical electric field is eventually emitted into a space after the vertical electric field turns to a vertically-polarized electric field at the outer edge portion of the opposing conductor plate.

The antenna device is therefore capable of transmitting a radio wave at the first frequency and has directionality in all directions on a plane parallel to the base plate with more or less a same gain. The antenna device configured as above is also capable of receiving a radio wave at the first frequency due to reversibility between transmission and reception.

A range within which a current and a voltage are distributed in the opposing conductor plate is limited at the second frequency because the second-frequency electric-field impeding element impedes a propagation of the vertical electric field heading from the short-circuiting portion toward the outer edge portion. In short, a range of the opposing conductor plate inducing an electrostatic capacitance between the opposing conductor plate and the base plate is limited and an effect same as an effect obtained by reducing the area of the opposing conductor plate can be obtained.

The second-frequency electric-field impeding element is disposed so as to make an electrical area of the opposing conductor plate for a signal at the second frequency to be an area of a proper size to generate an electrostatic capacitance that undergoes parallel resonance with inductance of the short-circuiting portion at the second frequency. Hence, parallel resonance takes place also at the second frequency due to an electrostatic capacitance generated between the opposing conductor plate and the base plate and inductance of the short-circuiting portion. Consequently, a vertically-polarized wave can be emitted in all directions in a direction of a plane parallel to the base plate. Naturally, the antenna device configured as above is also capable of receiving a radio wave at the second frequency due to reversibility between transmission and reception.

According to the configuration as above, the antenna device becomes capable of transmitting and receiving radio waves at two or more frequencies. A configuration to transmit and receive a radio wave at the second frequency can be realized by additionally providing the second-frequency electric-field impeding element to the configuration of transmitting and receiving a radio wave at the first frequency. Because the second-frequency electric-field impeding element is provided between the short-circuiting portion and the outer edge portion of the opposing conductor plate, an area of the opposing conductor plate is not increased.

That is to say, the configuration as above enables an antenna device to transmit and receive radio waves at two or more frequencies while reducing a size in comparison with the configuration disclosed in Patent Literature 1.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS (First Embodiment)

Figure 1:
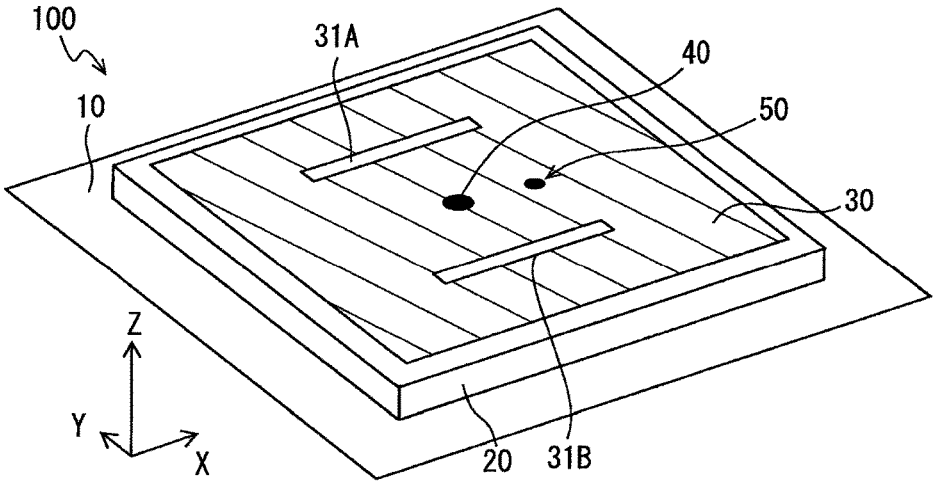
FIG. 1 is a perspective view showing an outer appearance of an antenna device 100.
Figure 2:
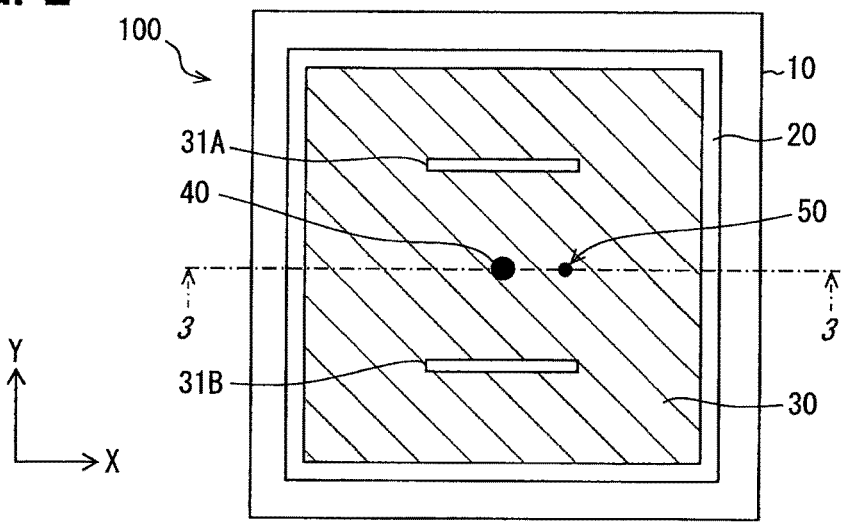
FIG. 2 is a top view of the antenna device 100.
Figure 3:
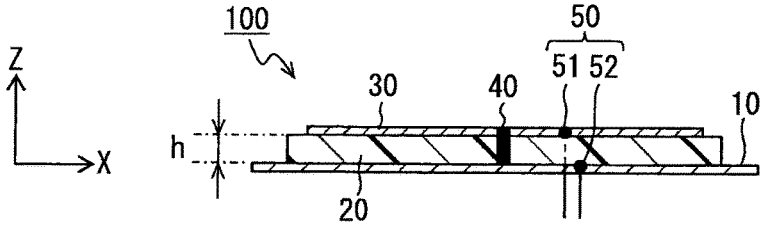
FIG. 3 is a sectional view of the antenna device 100 taken along the line 3-3 of FIG. 2.

Hereinafter, a first embodiment of the present disclosure will be described using the drawings. FIG. 1 is a perspective view showing an outer appearance as an example of a schematic configuration of an antenna device 100 according to the present embodiment. FIG. 2 shows a top view of the antenna device 100. FIG. 3 is a sectional view of the antenna device 100 taken along the line 3-3 of FIG. 2.

The antenna device 100 is employed in, for example, a vehicle and transmits and receives or either transmits or receives radio waves at a first frequency (for example, 750 MHz) and radio waves at a second frequency (for example, 1700 MHz). The antenna device 100 is connected to a radio (not shown) via, for example, a coaxial cable (not shown). Signals received at the antenna device 100 are successively outputted to the radio.

The radio uses signals received at the antenna device 100 and also supplies the antenna device 100 with high-frequency power corresponding to transmission signals. The present embodiment will describe a case where a coaxial cable is adopted as an electrical supply line to the antenna device 100. However, other known electrical supply lines, such as a feeder, are also available. A specific configuration of the antenna device 100 will be described in the following.

As are shown in FIGS. 1 to 3, the antenna device 100 includes a base plate 10, a supporting portion 20, an opposing conductor plate 30, a short-circuiting portion 40, and a power-feed portion 50.

The base plate 10 is a plate (including foil) of a square shape made of a conductor, such as copper. The base plate 10 is electrically connected to an outer conductor of the coaxial cable and generates ground potential (earth potential) across the antenna device 100. The base plate 10 only has to be larger than the opposing conductor plate 30 and is not necessarily of a square shape. For example, the base plate 10 may be of an oblong shape, any other polygonal shape, or a circular shape (including an elliptical shape). It goes without saying that the base plate 10 may be of a combined shape of a linear portion and a curve portion.

The supporting portion 20 is a member of a plate shape made of an electrical insulating material, such as resin, and having a predetermined thickness h (see FIG. 3). The supporting portion 20 is a member used to dispose the base plate 10 and the opposing conductor plate 30 of a plate shape in such a manner that plane portions oppose each other at a predetermined interval h. Hence, a shape of the supporting portion 20 is not limited to a plate shape. The supporting portion 20 may be multiple poles supporting the base plate 10 and the opposing conductor plate 30 oppositely at the predetermined interval h.

In the present embodiment, a space between the base plate 10 and the opposing conductor plate 30 is filled with resin (that is, the supporting portion 20). However, the present disclosure is not limited to the configuration as above. A space between the base plate 10 and the opposing conductor plate 30 may be hollow (or vacuum) or filled with a dielectric body having a predetermined dielectric constant. Further, structures of the examples as above may be combined.

The opposing conductor plate 30 is a plate (including foil) of a square shape made of a conductor, such as copper. The opposing conductor plate 30 is disposed oppositely and parallel (or substantially parallel) to the base plate 10 via the supporting portion 20. In the preset embodiment, a shape of the opposing conductor plate 30 is a square shape. However, alternatively, the opposing conductor plate 30 may be of an oblong shape or a shape other than an oblong shape (for example, a circular shape or a hexagonal shape).

The opposing conductor plate 30 and the base plate 10 opposing each other can be deemed as a capacitor generating an electrostatic capacitance corresponding to an area of the opposing conductor plate 30. An area of the opposing conductor plate 30 is an area of a proper size to generate an electrostatic capacitance that undergoes parallel resonance with an inductance component of the short-circuiting portion 40 at the predetermined first frequency. The first frequency may be designed as needed and is set to 750 MHz herein.

The opposing conductor plate 30 is provided with slots 31A and 31B being a linear shape and having a length with which each does not resonate at the first frequency and resonates at a second frequency. The slots 31A and 31B are provided at symmetrical positions with respect to the short-circuiting portion 40 while aligning a longitudinal direction to be orthogonal to a direction heading from the short-circuiting portion 40 toward an edge portion of the opposing conductor plate 30. The second frequency only has to be higher than the first frequency and has a value set as needed. Herein, the second frequency is set to 2100 MHz as an example. The slots 31A and 31B have a same length.

A length of each of the slots 31A and 31B may be designed according to a wavelength of a radio wave at a frequency (herein, the second frequency) at which each is designed to resonate. Herein, a length of the slots 31A and 31B is comparable to half a wavelength of the second frequency (second wavelength) as an example. A value corresponding to a length comparable to half the second wavelength means a value at which the slots 31A and 31B have an electrical length equal to half the second wavelength. An electrical length is referred to also as an effective length.

In a case where a space between the opposing conductor plate 30 and the base plate 10 is filled with a dielectric body having a predetermined dielectric constant, the slots 31A and 31B may have an electrical length comparable to half the second wavelength by taking an influence of a wavelength shortening effect by the dielectric body into consideration. In a case where the antenna device 100 is disposed on a metal plate sufficiently large for a size of the antenna device 100, a length of the slots 31A and 31B may be determined by taking an influence of the metal plate present near the antenna device 100 into consideration. It should be noted, however, that a length of the slots 31A and 31B is not limited to an electrical length equal to half the second wavelength. Each of the slots 31A and 31B only has to resonate at the second frequency and may have any other reasonable length.

A disclosing party conducted various tests and confirmed that a length necessary for the slots 31A and 31B to resonate at the second frequency varies with a distance to each of the slots 31A and 31B from the short-circuiting portion 40. To be more specific, when the slots 31A and 31B are provided at positions relatively close to the short-circuiting portion 40, the slots 31A and 31B have to have a length longer than half the second wavelength. Meanwhile, when the slots 31A and 31B are provided at positions relatively remote from the short-circuiting portion 40, the slots 31A and 31B can have a length shorter than half the second wavelength.

Hence, a length of the slots 31A and 31B may be determined according to positions at which the slots 31A and 31B are disposed (distance from the short-circuiting portion 40) on the opposing conductor plate 30 in addition to an electrical length of the second wavelength.

A width of each of the slots 31A and 31B is set to a value to be electrically and sufficiently short for a wavelength of the second frequency (second wavelength), for example, one tenth of the second wavelength at most.

The short-circuiting portion 40 is a portion electrically connected to the opposing conductor plate 30 and the base plate 10 and provided to a center portion of the opposing conductor plate 30. The term, "the center portion", referred to herein means an intersection of diagonal lines (that is, a center) of the opposing conductor plate 30 or a vicinity of the center. The short-circuiting portion 40 may be realized by a conductive pin (short pin). Inductance of the short-circuiting portion 40 can be adjusted with a thickness of the short pin.

The phrase, "the vicinity of the center of the opposing conductor plate 30", referred to herein means a region where a deviation of directionality arising from displacement between the center of the opposing conductor plate 30 and a position at which the short-circuiting portion 40 is provided falls within a predetermined allowable range.

The power-feed portion 50 is a portion electrically connecting the antenna device 100 and the coaxial cable. As is shown in FIG. 3, the power-feed portion 50 includes a power-feed point 51 at which an inner conductor of the coaxial cable and the opposing conductor plate 30 are electrically connected and a grounding point 52 at which an outer conductor of the coaxial cable and the base plate 10 are electrically connected. The power-feed point 51 may be disposed on the opposing conductor plate 30 at a position at which impedance of the coaxial cable is matched to impedance of the antenna device 100 at two or more target frequencies for transmission and reception by the antenna device 100. An impedance-matched state is not limited to a state of perfect impedance matching and includes a state in which a loss caused by an impedance mismatch falls within a predetermined allowable range.

The radio transmits a signal at a desired frequency and also receives a radio wave at a desired frequency when electrical power energy is supplied to the antenna device 100 from the power-feed portion 50. The power-feed portion 50 may be configured so as to connect the coaxial cable and the antenna device 100 via a known matching circuit or a known filter circuit.

The antenna device 100 described as above is employed in, for example, a mobile object, such as a vehicle. In a case where the antenna device 100 is employed in a vehicle, the antenna device 100 may be installed in a roof portion of the vehicle in such a manner that the base plate 10 is substantially on a level and a direction heading from the base plate 10 toward the opposing conductor plate 30 substantially coincides with a zenith direction.

An operation of the antenna device 100 will now be described. The antenna device 100 has two operation modes. One is a mode (first-frequency mode) in which radio waves at the first frequency are transmission and reception targets and the other is a mode (second-frequency mode) in which radio waves at the second frequency are transmission and reception targets.

An operation of the antenna device 100 when transmitting (emitting) radio waves and an operation when receiving radio waves are reversible to each other. Hence, the following will describe an operation when the antenna device 100 emits radio waves in each of the operation modes as an example, and a description of an operation when receiving radio waves is omitted herein.

In the following, for ease of description, a configuration and an operation of the antenna device 100 will be described by introducing a concept of a three-dimensional coordinate system, in which a direction parallel to one side on an outer periphery of the opposing conductor plate 30 is given as an X axis, a direction orthogonal to the X axis on a plane parallel to the opposing conductor plate 30 is given as a Y axis, and a direction orthogonal to both of the X axis and the Y axis and heading from the base plate 10 toward the opposing conductor plate 30 is given as a Z axis.

The first-frequency mode will be described first. As has been described, the opposing conductor plate 30 is short-circuited to the base plate 10 by the short-circuiting portion 40 provided in the center portion and an area of the opposing conductor plate 30 is an area of a proper size to generate an electrostatic capacitance that undergoes parallel resonance with inductance of the short-circuiting portion 40 at the first frequency.

Figure 4:
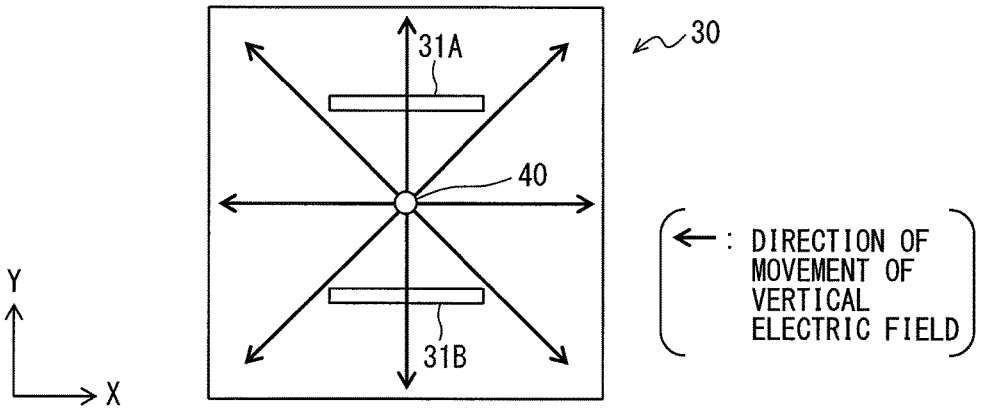
FIG. 4 is a conceptual view used to describe a direction of movement of a vertical electric field in a first-frequency mode.

Hence, parallel resonance takes place due to exchange of energy between the inductance and the electrostatic capacitance and an electric field vertical to the base plate 10 (and the opposing conductor plate 30) is induced between the base plate 10 and the opposing conductor plate 30. As is indicated by thick arrows of FIG. 4, the vertical electric field propagates from the short-circuiting portion 40 toward the edge portion of the opposing conductor plate 30. The vertical electric field eventually propagates in a space after the vertical electric field turns to a vertically-polarized electric field at the edge portion of the opposing conductor plate 30. The slots 31A and 31B provided to the opposing conductor plate 30 have a length with which each does not resonate at the first frequency. Hence, influences of the slots 31A and 31B on a propagation of the vertical electric field are negligible.

Figure 5:
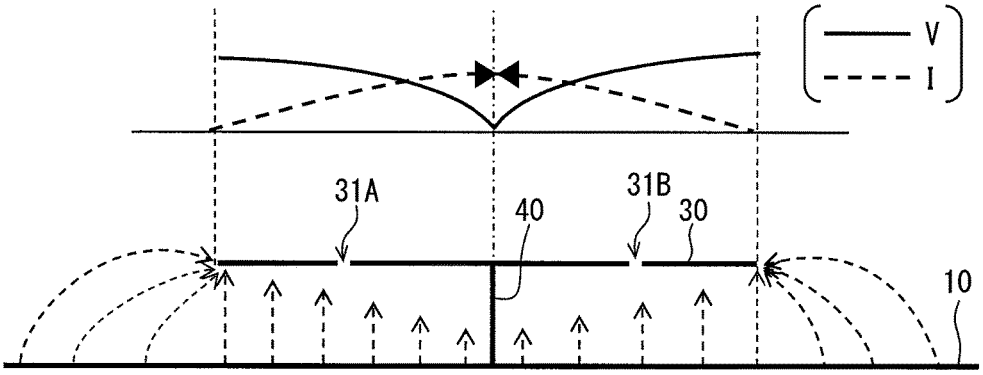
FIG. 5 is a conceptual view used to describe a current distribution, a voltage distribution, and an electric field distribution near an opposing conductor plate 30 at a first frequency.

More specifically, when the antenna device 100 is in the first-frequency mode, as is shown in FIG. 5, a current flows through the opposing conductor plate 30 in a direction from the edge portion of the opposing conductor plate 30 to the center portion in which the short-circuiting portion 40 is provided. That is to say, a current concentrates in the center portion of the opposing conductor plate 30 and amplitude of a current standing wave becomes a maximum in the center portion and decreases to 0 at both end portions of the opposing conductor plate 30.

Because the short-circuiting portion 40 is provided to the center portion of the opposing conductor plate 30, amplitude of a voltage standing wave becomes a maximum at the both end portions and decreases to 0 in or near the center portion of the opposing conductor plate 30. A sign of a voltage is same (positive in FIG. 5) in a vertical direction in any region.

A vertical electric field induced between the opposing conductor plate 30 and the base plate 10 is proportional to a distribution of a voltage. Hence, a direction of movement of the vertical electric field is same (for example, a direction heading from the short-circuiting portion 40 toward the edge portion of the opposing conductor plate 30) in any region when viewed from the short-circuiting portion 40. Intensity of the vertical electric field decreases to 0 in or near the center portion and becomes a maximum in an outer edge portion of the opposing conductor plate 30. In short, intensity of the electric field increases from the short-circuiting portion 40 toward the outer edge portion of the opposing conductor plate 30 and the vertical electric field is emitted after the vertical electric field turns to a vertically-polarized wave at the edge portion.

Figure 6:
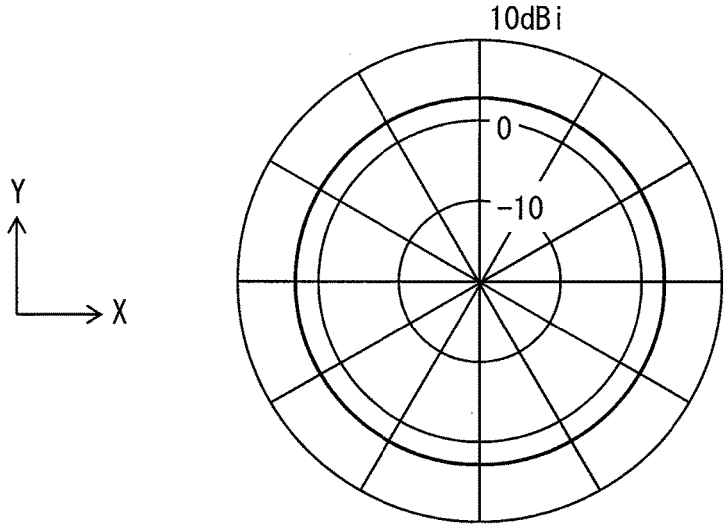
FIG. 6 is a view showing directionality in a horizontal direction for a radio wave at the first frequency.

Accordingly, the antenna device 100 has directionality of a vertically-polarized wave in all directions heading from the center portion (that is, the short-circuiting portion 40) toward the edge portion of the opposing conductor plate 30 at the first frequency. In particular, in a case where the base plate 10 is disposed on a level, the antenna device 100 has directionality in a horizontal direction. In addition, because a propagation direction of the electric field is symmetrical with respect to the short-circuiting portion 40, as is shown in FIG. 6, the antenna device 100 has more or less a same gain in all directions on a horizontal plane.

The second-frequency mode will now be described. A concept same as the concept underlying an operation of the antenna device 100 at the first frequency described above can be applied to an operation of the antenna device 100 at the second frequency. That is to say, parallel resonance of inductance of the short-circuiting portion 40 and an electrostatic capacitance generated by the base plate 10 and the opposing conductor plate 30 is used.

It should be noted, however, that an operation in the second-frequency mode is different in that the slots 31A and 31B provided to the opposing conductor plate 30 have influences on a propagation of a vertical electric field induced between the base plate 10 and the opposing conductor plate 30. The difference will be described more specifically in the following.

The slots 31A and 31B are provided so as to resonate at the second frequency. Hence, the slots 31A and 31B resonate when a high-frequency signal at the second frequency is supplied. A portion on the opposing conductor plate 30 where the slots 31A and 31B are provided is a portion where impedance is relatively high for a signal at the second frequency.

In a case where the slots 31A and 31B include components orthogonal to a direction of movement of a vertical electric field induced between the base plate 10 and the opposing conductor plate 30, the slots 31A and 31B have an effect of impeding a propagation of the vertical electric field. The phrase, "a direction of movement of the vertical electric field", referred to herein means a direction heading from the short-circuiting portion 40 toward the edge portion of the opposing conductor plate 30 as has been described in the first-frequency mode above.

In the present embodiment, the slots 31A and 31B are provided at symmetrical positions with respect to the short-circuiting portion 40 while aligning a longitudinal direction to be orthogonal to a direction heading from the short-circuiting portion 40 toward the edge portion of the opposing conductor plate 30 (that is, a direction of movement of the vertical electric field). In short, the slots 31A and 31B function so as to impede a propagation of the vertical electric field as is shown in FIG. 7.

When a propagation of the vertical electric field heading from the short-circuiting portion 40 toward the edge portion of the opposing conductor plate 30 is impeded by the slots 31A and 31B, a range within which a current and a voltage are distributed in the opposing conductor plate 30 is limited. That is to say, a range of the opposing conductor plate 30 inducing an electrostatic capacitance between the opposing conductor plate 30 and the base plate 10 is limited. Hence, an effect same as an effect obtained by reducing an area of the opposing conductor plate 30 can be achieved.

Figure 7:
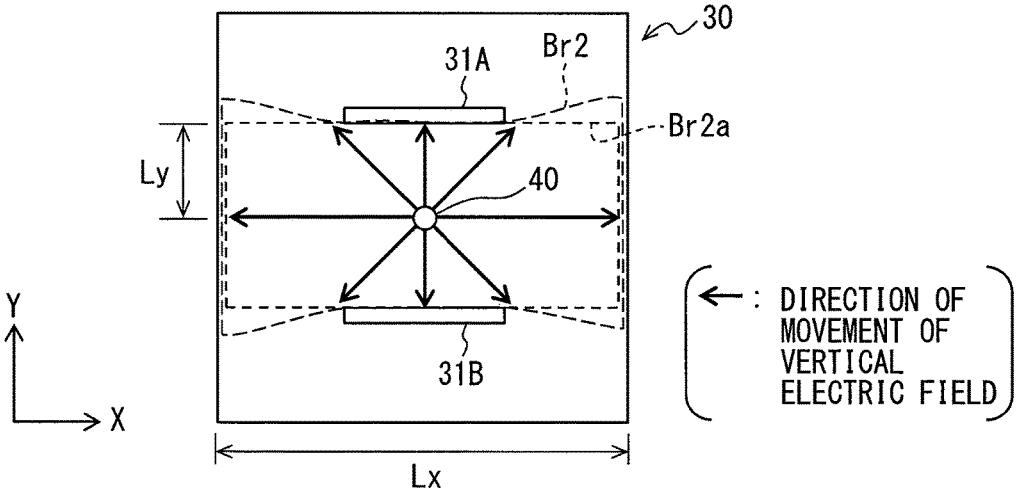
FIG. 7 is a conceptual view used to describe a region in which the vertical electric field propagates in a second-frequency mode.

A long broken line of FIG. 7 conceptually indicates an edge portion Br2 along a region (second-frequency operation region) of the opposing conductor plate 30 inducing an electrostatic capacitance between the opposing conductor plate 30 and the base plate 10 when a propagation of a vertical electric field is impeded by the slots 31A and 31B. A region enclosed by a short broken line Br2*a* of FIG. 7 schematically represents the second-frequency operation region. An area of the second-frequency operation region corresponds to an electrical area of an opposing conductor plate for a signal at a second frequency referred to in the appended claims.

In a case where an area of the second-frequency operation region is an area of a proper size to generate an electrostatic capacitance that undergoes parallel resonance with inductance of the short-circuiting portion 40 at the second frequency, parallel resonance takes place at the second frequency, too, and a vertically-polarized wave can be emitted from the edge portion Br2 of the second-frequency operation region. That is to say, emission of a radio wave at the second frequency is enabled by disposing the slots 31A and 31B so as to make an area of the second-frequency operation region to be an area of a proper size to generate an electrostatic capacitance that gives rise to parallel resonance at the second frequency.

An area of the second-frequency operation region can be found in a simple manner from an area of an oblong enclosed by the short broken line Br2*a*. To be more specific, the area can be found by multiplying a distance Ly from the short-circuiting portion 40 to the slot 31A by two and by multiplying the product (Ly×2) by a length Lx of the opposing conductor plate 30 in a direction (herein, an X-axis direction) orthogonal to a direction in which the slots 31A and 31B are aligned side by side.

The distance Ly from the short-circuiting portion 40 to each of the slots 31A and 31B may be found from an area necessary for the second-frequency operation region by an inverse operation. That is to say, an area necessary for the second-frequency operation region is calculated using the second frequency and inductance of the short-circuiting portion 40 and the calculated area is divided by the length Lx of the opposing conductor plate 30 in the X-axis direction. A quotient thus found is further divided by two, and a quotient of the last division is found to be the distance Ly from the short-circuiting portion 40 to each of the slots 31A and 31B.

The distance Ly from the short-circuiting portion 40 to each of the slots 31A and 31B found in the manner as above naturally includes an error because a calculation is performed using a model in which a propagation region of the vertical electric field is simplified. In practical use, positions of the slots 31A and 31B may be adjusted finely and determined by a simulation or a real test so as to achieve desired performance at the second frequency. A length of each of the slots 31A and 31B may be adjusted according to the distance Ly from the short-circuiting portion 40 for the slots 31A and 31B to resonate at the second frequency.

Figure 8:
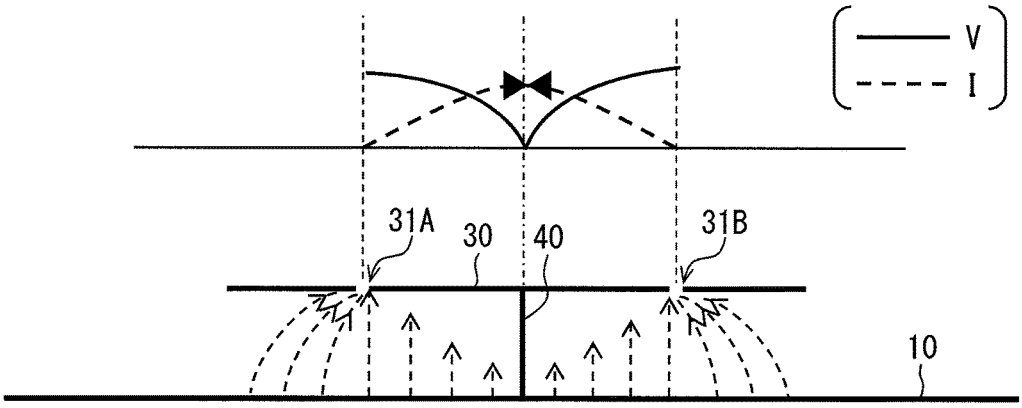
FIG. 8 is a conceptual view used to describe a current distribution, a voltage distribution, and an electric field distribution near the opposing conductor plate 30 at a second frequency.

FIG. 8 is a conceptual view of a current distribution, a voltage distribution, and an electric field distribution in a cross section parallel to the Y axis and passing across the short-circuiting portion 40 when the antenna device 100 is operating in the second-frequency mode. Because the second-frequency operation region has an area of a proper size to give rise to parallel resonance at the second frequency, as is shown in FIG. 8, a vertical electric field is induced between the base plate 10 and the opposing conductor plate 30. The vertical electric field propagates from the short-circuiting portion 40 toward the edge portion Br2 of the second-frequency operation region. The vertical electric field eventually propagates in a space after the vertical electric field turns to a vertically-polarized wave at the edge portion Br2.

For example, in a direction heading from the short-circuiting portion 40 toward the slots 31A and 31B, a vertical electric field induced between the base plate 10 and the opposing conductor plate 30 is emitted into a space after the vertical electric field turns to a vertically-polarized wave at the slots 31A and 31B. In a direction heading from the short-circuiting portion 40 toward the X-axis direction, the vertical electric field propagates to the edge portion of the opposing conductor plate 30 and the vertical electric field is emitted into a space after the vertical electric field turns to a vertically-polarized wave at the edge portion.

Figure 9:
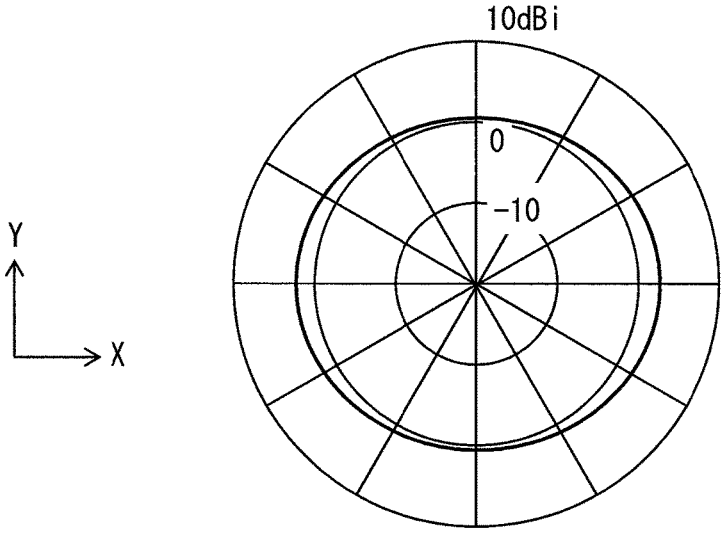
FIG. 9 is a view showing directionality in the horizontal direction for a radio wave at the second frequency.

As has been described above, in the antenna device 100, an electric field propagates also at the second frequency in a direction heading from the short-circuiting portion 40 toward the edge portion Br2 of the second-frequency operation region. Hence, as is shown in FIG. 9, the antenna device 100 emits a vertically-polarized wave at the second frequency in all directions on the horizontal plane with more or less a same gain. In FIG. 9, a gain in a Y-axis direction is slightly smaller than a gain in the X-axis direction because a vertical electric field is emitted into a space from an end of the opposing conductor plate 30 in the X-axis direction whereas the vertical electric field turns to a vertically-polarized wave at or near the slots 31A and 31B in the Y-axis direction. That is to say, a gain in the Y-axis direction becomes slightly smaller because emission and reception of a vertically-polarized wave in the Y-axis direction is impeded slightly by the opposing conductor plate 30 in a portion on an outer side of the slots 31A and 31B when viewed from the short-circuiting portion 40.

According to the configuration described above, the antenna device 100 is capable of transmitting and receiving or either transmitting or receiving radio waves at the first frequency and radio waves at the second frequency. As are shown in FIG. 6 and FIG. 9, the antenna device 100 has directionality in all directions parallel to the base plate 10 at either frequency.

Figure 10:
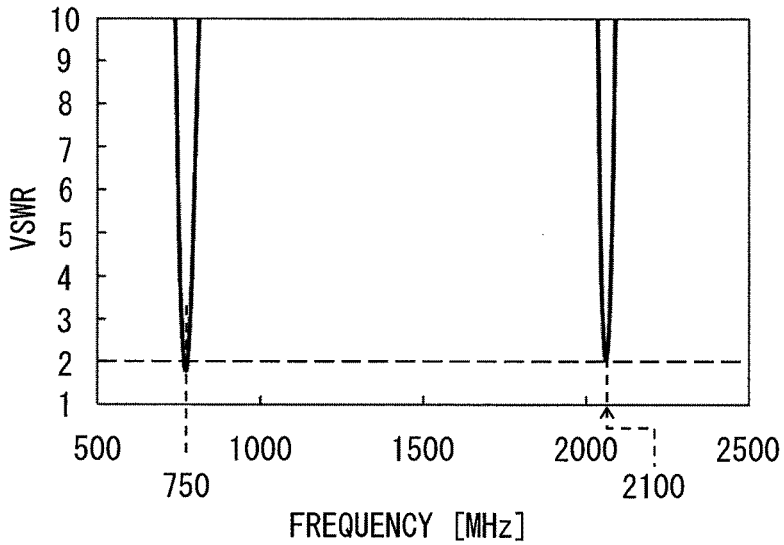
FIG. 10 is a graph showing a relation of a frequency and a voltage standing wave ratio in the antenna device 100 according to the embodiment.

FIG. 10 is a graph showing a voltage standing wave ratio (VSWR) of the antenna device 100 at each frequency. As is shown in FIG. 10, according to the configuration of the present embodiment, the VSWR is about two at either of the first frequency (750 MHz) and the second frequency (2100 MHz), which demonstrates that the antenna device 100 has performance within a practically allowable range (normally three or less).

According to the configuration as above, a configuration to transmit and receive radio waves at the second frequency can be realized by providing the slots 31A and 31B which resonate at the second frequency at predetermined positions on the opposing conductor plate 30 having an area of a proper size to transmit and receive radio waves at the first frequency.

To be more specific, the slots 31A and 31B which impede a propagation of a vertical electric field by resonating at the second frequency are disposed at positions at which an area of the second-frequency operation region defined by the slots 31A and 31B generates an electrostatic capacitance that gives rise to parallel resonance with inductance of the short-circuiting portion 40 at the second frequency.

That is to say, the second-frequency operation region to give rise resonance at the second frequency can be realized by using a part of a region (first-frequency operation region) to give rise to parallel resonance at the first frequency. The first-frequency operation region is the entire opposing conductor plate 30.

Hence, in comparison with a configuration of, for example, Patent Literature 1, in which the first-frequency operation region and the second-frequency operation region are separated in the opposing conductor plate 30, an area of the opposing conductor plate 30 can be restricted by the configuration of the present embodiment. Hence, an effect of making the antenna device 100 smaller can be achieved.

While the above has described one embodiment of the present disclosure, it should be appreciated that the present disclosure is not limited to the embodiment above and embodiments below are also within the technical scope of the present disclosure. Besides the embodiments below, the embodiment above can be modified in various manners within the scope of the present disclosure. In the following, members furnished with functions same as the functions furnished to the members shown in the drawings used to describe the embodiment above are labeled with same reference numerals and a description is not repeated. In a case where only a part of the configuration is described, the first embodiment described above is applied to a rest of the configuration.

(First Modification)

The embodiment above has described an example of the configuration in which radio waves at two target frequencies, namely the first frequency and the second frequency, are transmitted and received. However, the present disclosure is not limited to the configuration as above. An antenna device may transmit and receive radio waves at three or more target frequencies. An antenna device is enabled to transmit and receive radio waves at three or more frequencies by disposing multiple slots which resonate at respective frequencies at predetermined positions of the opposing conductor plate 30.

The antenna device does not have to transmit and receive radio waves at all of the multiple frequencies and may be configured in such a manner so as to only transmit or receive a radio wave at a particular frequency. Even when the antenna device is used to either transmit or receive a radio wave at a particular frequency, the antenna device is capable of transmitting and receiving radio waves due to reversibility between transmission and reception.

Figure 11:
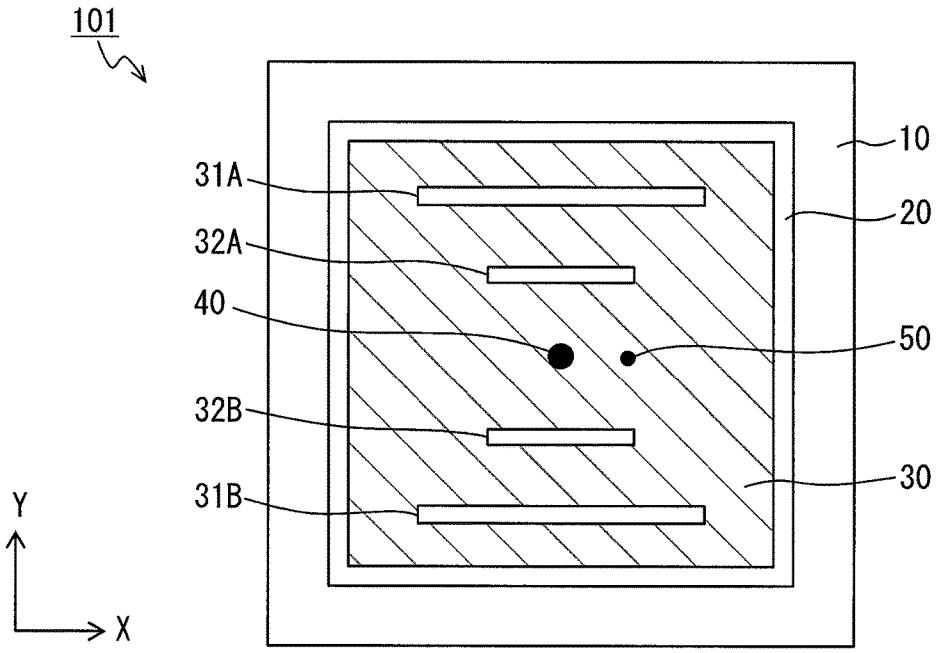
FIG. 11 is a top view showing a schematic configuration of an antenna device 101 according to a first modification.

The first modification will describe an example of a configuration of an antenna device 101 which transmits and receives radio waves at three target frequencies, namely the first frequency, the second frequency, and a third frequency. As is shown in FIG. 11, the antenna device 101 of the first modification includes the opposing conductor plate 30 having an area of a proper size to transmit and receive radio waves at the first frequency and the opposing conductor plate 30 is provided with slots 31A and 31B to define second-frequency operation region and slots 32A and 32B to define a third-frequency operation region.

The third-frequency operation region is a region determined according to a concept same as the concept underlying the second-frequency operation region. More specifically, the third-frequency operation region is a region of the opposing conductor plate 30 inducing a desired electrostatic capacitance between the opposing conductor plate 30 and the base plate 10 at the third frequency when a propagation of a vertical electric field induced at the third frequency is impeded by the slots 32A and 32B. The term, "a desired electrostatic capacitance", referred to herein means an electrostatic capacitance that gives rise to parallel resonance with inductance of the short-circuiting portion 40 at the third frequency. An area of the third-frequency operation region corresponds to an electrical area of an opposing conductor plate for a signal at a third frequency referred to in the appended claims.

The second frequency is higher than the first frequency and the third frequency is higher than the second frequency. For example, the first frequency is set to 750 MHz, the second frequency to 1700 MHz, and the third frequency to 2100 MHz.

The slots 31A and 31B are slots (cut-out portions) having a length with which each resonates at the second frequency and does not resonate at the first frequency and the third frequency. Slots 31A and 31B are disposed at positions at which the second-frequency operation region defined by the slots 31A and 31B has an area of a proper size to give rise to parallel resonance with inductance of the short-circuiting portion 40 at the second frequency. As an example, the slots 31A and 31B are disposed symmetrically with respect to the short-circuiting portion 40.

More specifically, the slot 31A is disposed parallel to the X axis while aligning a perpendicular bisector to pass across the short-circuiting portion 40. The slot 31B is disposed at a symmetric position to the slot 31A with respect to the short-circuiting portion 40.

The slots 32A and 32B are slots having a length with which each resonates at the third frequency and does not resonate at the first frequency and the second frequency. The slots 32A and 32B are disposed at positions at which the third-frequency operation region defined by the slots 32A and 32B has an area of a proper size to give rise to parallel resonance with inductance of the short-circuiting portion 40 at the third frequency. Herein, the slots 32A and 32B are disposed oppositely to each other and symmetrically with respect to the short-circuiting portion 40 in a region closer to the short-circuiting portion 40 than the slots 31A and 31B.

More specifically, the slot 32A is disposed parallel to the slot 31A while aligning a perpendicular bisector to pass across the short-circuiting portion 40. Also, a distance from the slot 32A to the short-circuiting portion 40 is made shorter than a distance from the slot 31A to the short-circuiting portion 40. The slot 32B is disposed at a symmetrical position to the slot 32A with respect to the short-circuiting portion 40. The slots 32A and 32B are shorter than the slots 31A and 31B because the slots 32A and 32B are slots for a higher target frequency.

According to the configuration above, the opposing conductor plate 30 is provided with operation regions corresponding to the respective frequencies by the slots 31A and 31B for one frequency and the slots 32A and 32B for the other frequency. In short, the antenna device 101 includes the opposing conductor plate 30 on which three operation regions respectively corresponding to the first frequency, the second frequency, and the third frequency, are defined.

Figure 12:
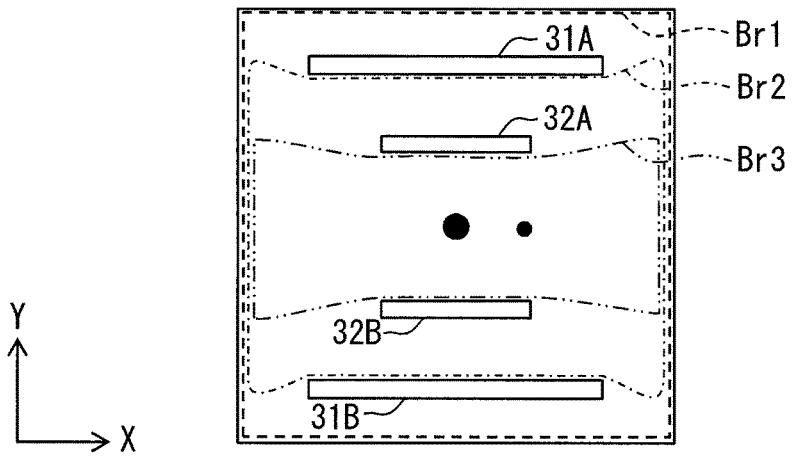
FIG. 12 is a view used to describe a first-frequency operation region, a second-frequency operation region, and a third-frequency operation region.

FIG. 12 is a conceptual view showing boundaries (that is, edge portions) of the respective operation regions. As has been described, the first-frequency operation region is the entire opposing conductor plate 30 and an edge portion Br1 (broken line of FIG. 12) of the first-frequency operation region substantially coincides with the edge portion of the opposing conductor plate 30. The second-frequency operation region is provided to the opposing conductor plate 30 in a part limited by the slots 31A and 31B. For example, as is shown in FIG. 12, an edge portion Br2 (alternate long and short dash line of FIG. 12) of the second-frequency operation region includes a portion along the slots 31A and 31B and a part of the edge portion of the opposing conductor plate 30. The third-frequency operation region is provided to the opposing conductor plate 30 in a part limited by the slots 32A and 32B. For example, as is shown in FIG. 12, an edge portion Br3 (alternate long and two short dashes line of FIG. 12) includes a portion along the slots 32A and 32B and a part of the edge portion of the opposing conductor plate 30. In FIG. 12, each of the edge portions Br1 through Br3 are displaced from one another for ease of understanding. However, all of the edge portions Br1 through Br3 are assumed to overlap one another in practice.

Figure 13:
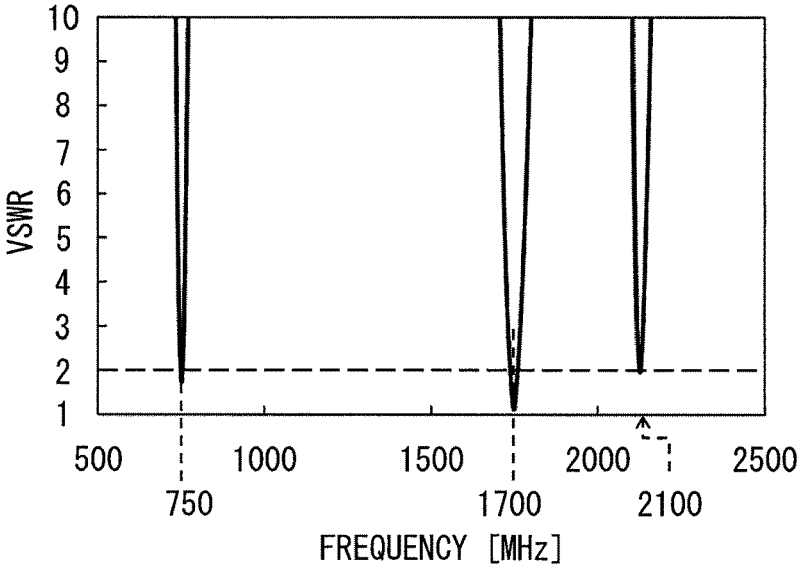
FIG. 13 is a graph showing a relation of a frequency and a voltage standing wave ratio in the antenna device 101 according to the first modification.

FIG. 13 shows a voltage standing wave ratio (VSWR) at each frequency in the antenna device 101 of the first modification. As is shown in FIG. 13, according to the configuration of the first modification, the VSWR is about two or less at any of the first frequency, the second frequency, and the third frequency, which demonstrates that the antenna device 101 has performance within a practically allowable range (normally three or less).

Figure 14:
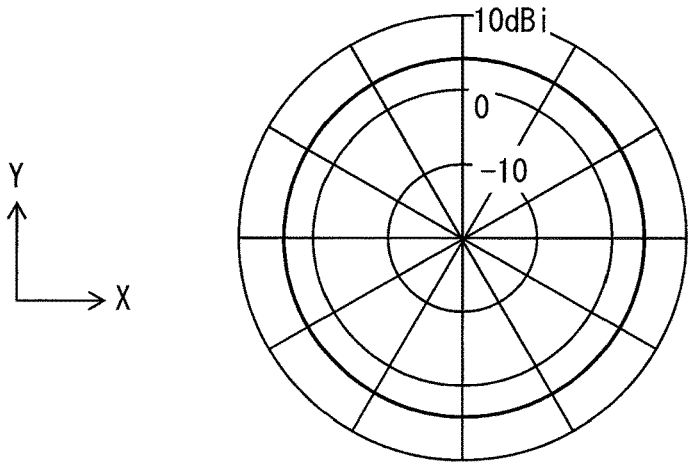
FIG. 14 is a view showing directionality of the antenna device 101 in the horizontal direction for a radio wave at the first frequency.
Figure 15:
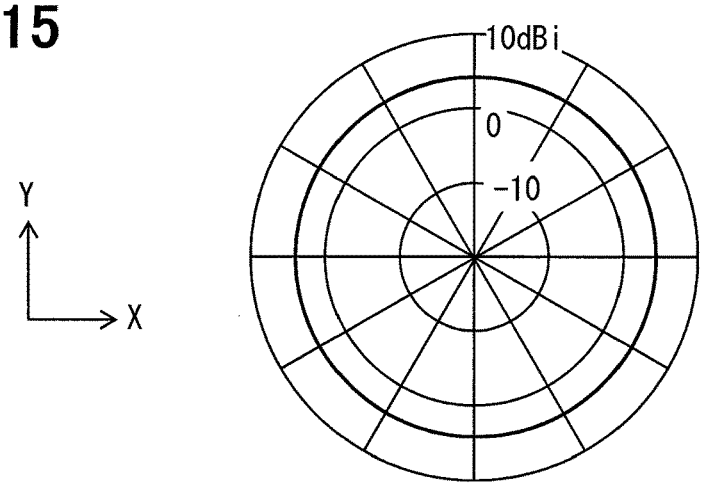
FIG. 15 is a view showing directionality of the antenna device 101 in the horizontal direction for a radio wave at the second frequency.
Figure 16:
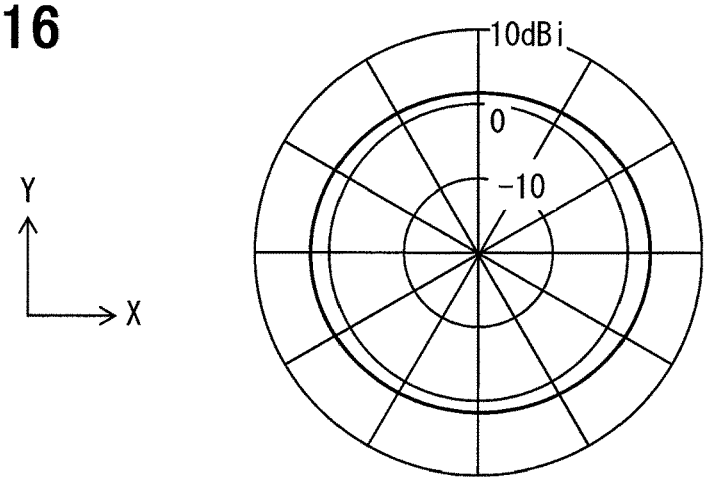
FIG. 16 is a view showing directionality of the antenna device 101 in the horizontal direction for a radio wave at a third frequency.

FIG. 14 indicates directionality in the horizontal direction (direction of an XY plane) at the first frequency. FIG. 15 indicates directionality in the horizontal direction at the second frequency. FIG. 16 indicates directionality in the horizontal direction at the third frequency.

As are shown in FIG. 14 through FIG. 16, according to the configuration of the first modification, a vertically-polarized wave can be emitted in all directions on a horizontal plane at any frequency with more or less a same gain. It is understood from a comparison among FIG. 14 through FIG. 16 that a gain in the Y-axis direction slightly decreases in comparison with a gain in the X-axis direction as the frequency becomes higher. Such a decrease is attributed to the configuration of the present embodiment in which slots for parallel resonance at a higher frequency are disposed closer to the short-circuiting portion 40 in the Y-axis direction.

That is to say, an area of the opposing conductor plate 30 present on an outer side of the edge portion of the operation region in the Y-axis direction increases as a frequency becomes higher. Hence, a gain tends to be restricted in the Y-axis direction. Meanwhile, the edge portion of the opposing conductor plate 30 coincides with the edge portion of the operation region at any frequency in the X-axis direction. That is to say, a member impeding an emission of a vertically-polarized wave into a space is absent in the X-axis direction. Hence, a decrease of a gain with a rise of the frequency is smaller in the X-axis direction than in the Y-axis direction.

Such a phenomenon is significantly influenced by locations of the slots 31A, 31B, 32A, and 32B. A gain in the Y-axis direction may not necessarily decrease as the frequency becomes higher depending on locations of the slots.

Herein, the configuration in which the slots 32A and 32B for the third frequency are provided closer to the short-circuiting portion 40 than the slots 31A and 31B for the second frequency as an example. However, the present disclosure is not limited to the example as above and a positional relation of the slots may be reversed. That is to say, the slots 31A and 31B for the second frequency may be provided closer to the short-circuiting portion 40 than the slots 32A and 32B for the third frequency. It is confirmed that a same effect can be achieved by adjusting lengths and positions of the slots even when the configuration is modified as above.

It should be noted, however, that an influence of the slots 31A and 31B for the second frequency on a propagation of a vertical electric field induced at the relatively high third frequency is more significant than an influence of the slots 32A and 32B for the third frequency on a propagation of a vertical electric field induced at the relative low second frequency. Accordingly, when the slots 31A and 31B for the second frequency are provided between the short-circuiting portion 40 and the slots 32A and 32B for the third frequency, respectively, the slots 31A and 31B for the second frequency may possibly impede a propagation of a vertical electric field induced at the third frequency.

Hence, as is shown in FIG. 11, it is preferable to configure in such a manner that the slots 32A and 32B for the third frequency are provided closer to the short-circuiting portion 40 than the slots 31A and 31B for the second frequency. That is to say, in a case where radio waves at three or more target frequencies are transmitted and received and slots corresponding to each frequency are disposed oppositely in line, it is preferable to dispose relatively short slots closer to the short-circuiting portion 40.

(Second Modification)

Figure 17:
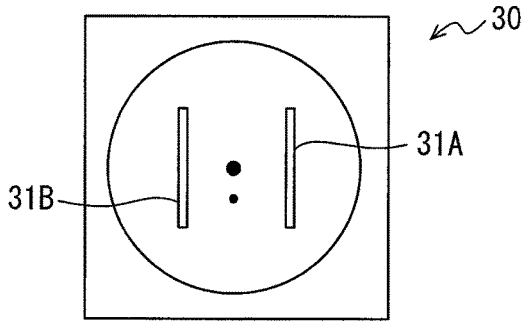
FIG. 17 is a view showing a modification of the opposing conductor plate 30.
Figure 18:
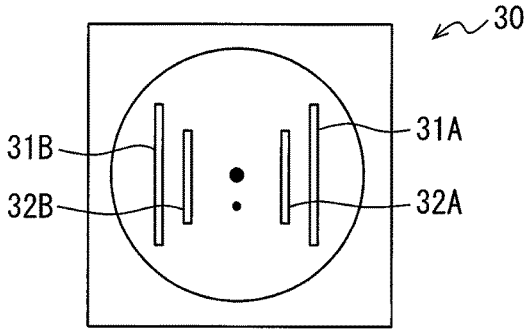
FIG. 18 is a view showing another modification of the opposing conductor plate 30.

The above has described an arrangement in which the opposing conductor plate 30 is of a square shape as an example. However, the preset disclosure is not limited to the example as above. As are shown in FIG. 17 and FIG. 18, the opposing conductor plate 30 may be of a circular shape instead. The embodiment above has described an arrangement in which the slots 31A, 31B, 32A, and 32B are disposed parallel (or substantially parallel) to the edge portion of the opposing conductor plate 30 as an example. However, the present disclosure is not limited to the example as above. Various slots may only have to be provided so as to include components orthogonal to a direction of movement of a vertical electric field induced between the base plate 10 and the opposing conductor plate 30. As are shown in FIG. 17 and FIG. 18, the slots do not have to be parallel fully to the edge portion of the opposing conductor plate 30.

(Third Modification)

Figure 19:
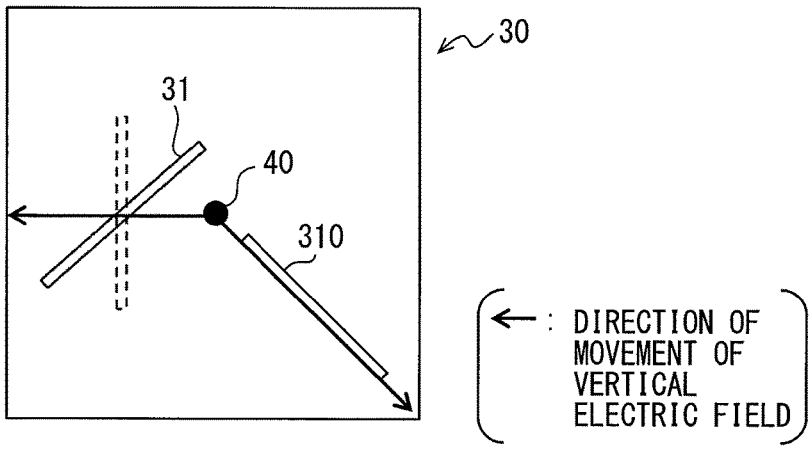
FIG. 19 is a view used to describe a relation of an angle of a slot 31 with respect to a direction of movement of a vertical electric field heading from a short-circuiting portion 40 toward an edge portion of the opposing conductor plate 30 and an effect of impeding a propagation of the vertical electric field by the slot 31.

As has been described, various slots (for example, the slot 31A) only have to be provided so as to include components orthogonal to a direction of movement of a vertical electric field induced between the base plate 10 and the opposing conductor plate 30. Hence, as is shown in FIG. 19, a slot 31 that is a linear shape may be provided at a predetermined angle (for example, 45 degrees) with respect to a direction of movement of a vertical electric field.

The slot 31 shown in the drawing is a slot which limits a range of the opposing conductor plate 30 inducing an electrostatic capacitance between the opposing conductor plate 30 and the base plate 10 by resonating at a desired frequency in a same manner as the slot 31A described above.

Another slot 310 is a slot in a case where the slot is provided so as not to include a component orthogonal to a direction of movement of a vertical electric field induced between the base plate 10 and the opposing conductor plate 30. In the case above where the slot 310 is provided while aligning a longitudinal direction along (parallel to) a direction of movement of a vertical electric field, an effect of limiting a range within which a current and a voltage are distributed in the opposing conductor plate 30 cannot be obtained.

(Fourth Modification)

Figure 20:
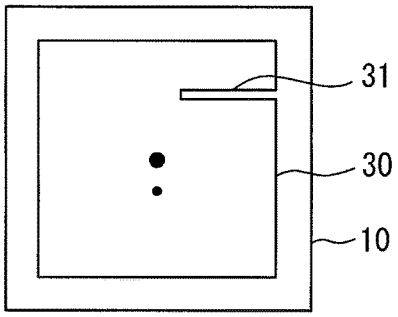
FIG. 20 is a view showing still another modification of the opposing conductor plate 30.
Figure 21:
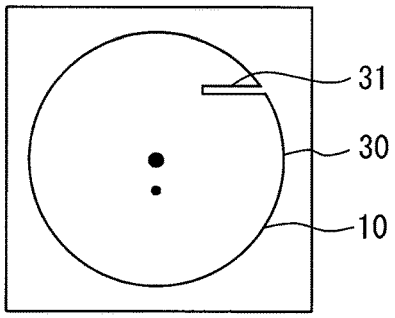
FIG. 21 is a view showing still another modification of the opposing conductor plate 30.

The above has described an arrangement in which two slots are provided symmetrically with respect to the short-circuiting portion 40 for one frequency (for example, the second frequency) as an example. However, the present disclosure is not limited to the example as above. For example, as are shown in FIG. 20 and FIG. 21, only one slot 31 may be provided to the opposing conductor plate 30 to transmit and receive radio waves at the second frequency and the slot 31 may be connected to the edge portion of the opposing conductor plate 30.

A length of the slot 31 and a relative position of the slot 31 with respect to the short-circuiting portion 40 may be determined as needed as long as the slot 31 includes a component orthogonal to a direction of movement of a vertical electric field induced between the base plate 10 and the opposing conductor plate 30 and a desired electrostatic capacitance is generated between the opposing conductor plate 30 and the base plate 10 by the orthogonal component.

In the embodiment, the first modification, and the second modification above, two slots used to transmit and receive radio waves at a particular frequency are provided symmetrically with respect to the short-circuiting portion 40 with a purpose of restricting a deviation of directionality. In other words, from a viewpoint of restricting a deviation of directionality, it is preferable to provide two slots symmetrically with respect to the short-circuiting portion 40 for each target frequency.

(Fifth Modification)

Figure 22:
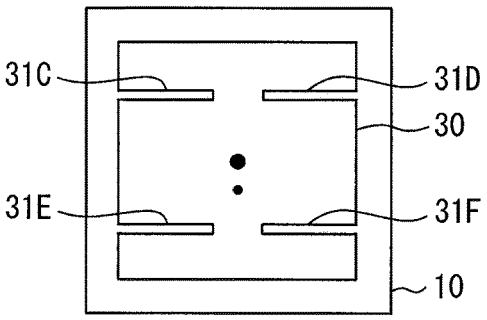
FIG. 22 is a view showing still another modification of the opposing conductor plate 30.
Figure 23:
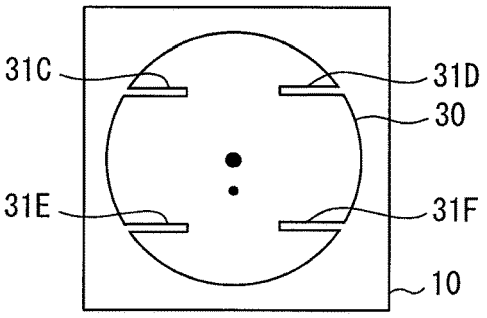
FIG. 23 is a view showing still another modification of the opposing conductor plate 30.

As are shown in FIG. 22 and FIG. 23, three or more slots having a length with which each resonates at the second frequency may be provided. The slots may be disposed for the opposing conductor plate 30 to generate a desired electrostatic capacitance with the base plate 10 at the second frequency. FIG. 22 and FIG. 23 show examples of a configuration in which four slots 31C to 31F having a length with which each resonates at the second frequency are provided to the opposing conductor plate 30.

(Sixth Modification)

Figure 24:
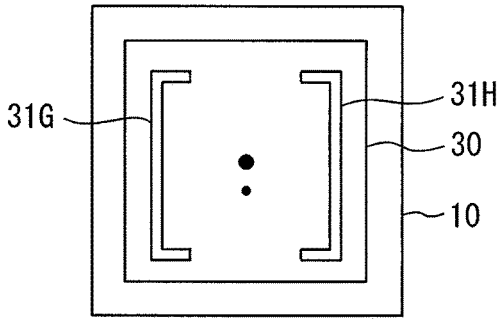
FIG. 24 is a view showing still another modification of the opposing conductor plate 30.

As is shown in FIG. 24, the slots may be of a C-shape. Slots 31G to 31J that are C-shaped may be of a linear shape obtained by linking two or more slots or a shape having a curved portion.

Figure 25:
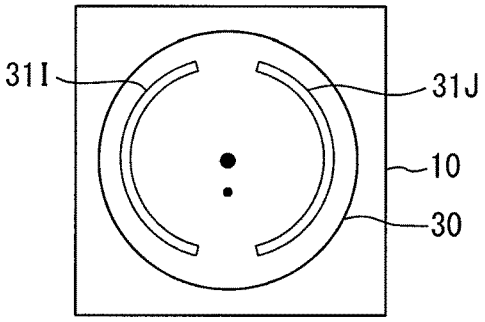
FIG. 25 is a view showing still another modification of the opposing conductor plate 30.

FIG. 24 and FIG. 25 show examples in which the slots 31G to 31J are disposed parallel to the edge portion of the opposing conductor plate 30 at a predetermined interval. However, the present disclosure is not limited to the example as above. The slots 31G to 31J are not necessarily parallel to the edge portion of the opposing conductor plate 30.

(Seventh Modification)

Figure 26:
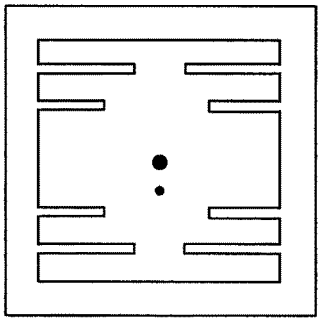
FIG. 26 is a view showing still another modification of the opposing conductor plate 30.
Figure 27:
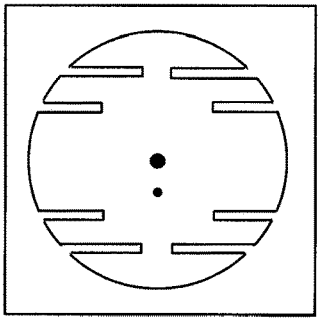
FIG. 27 is a view showing still another modification of the opposing conductor plate 30.

The opposing conductor plates 30 shown in FIG. 26 and FIG. 27 have arrangements when the configuration of the fifth modification (see FIG. 22 and FIG. 23) above is further modified. That is to say, in contrast to the fifth modification configured to transmit and receive radio waves at two target frequencies, namely the first frequency and the second frequency, FIG. 26 and FIG. 27 show a configuration to transmit and receive radio waves at a total of three target frequencies, namely the first frequency, the second frequency, and the third frequency.

For example, of multiple slots provided to the opposing conductor plates 30 shown in FIG. 26 and FIG. 27, four relatively long slots provided at positions remote from the short-circuiting portion 40 are slots to define the second-frequency operation region. The other four relatively short slots provided at positions relatively close to the short-circuiting portion 40 are slots to define the third-frequency operation region.

(Eighth Modification)

The opposing conductor plates 30 shown in FIG. 28, FIG. 29, FIG. 30, and FIG. 31 have arrangements when the configuration of the sixth modification (see FIG. 24 and FIG. 25) above is further modified. That is to say, in contrast to the sixth modification configured to transmit and receive radio waves at two target frequencies, namely the first frequency and the second frequency, the opposing conductor plates 30 shown in FIG. 28 through FIG. 31 are configured to transmit and receive radio waves at a total of three target frequencies, namely the first frequency, the second frequency, and the third frequency.

For example, of multiple slots provided to the opposing conductor plates 30 shown in FIG. 28 through FIG. 31, two opposing slots provided on a side relatively remote from the short-circuiting portion 40 are slots to define the second-frequency operation region. The other two slots on a side relatively close to the short-circuiting portion 40 are slots to define the third-frequency operation region.

Figure 28:
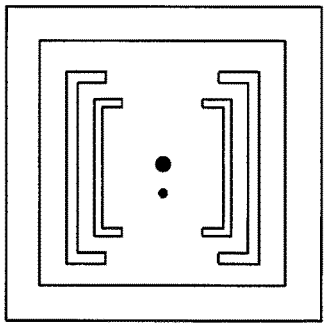
FIG. 28 is a view showing still another modification of the opposing conductor plate 30.
Figure 29:
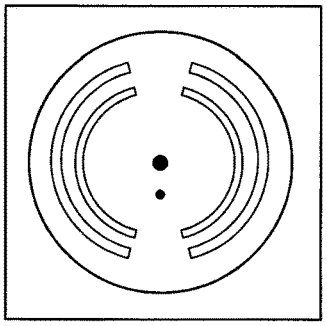
FIG. 29 is a view showing still another modification of the opposing conductor plate 30.
Figure 30:
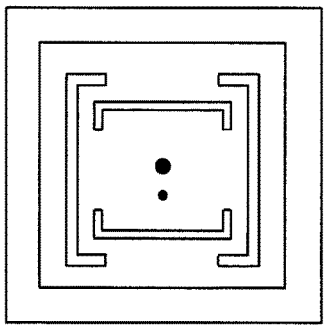
FIG. 30 is a view showing still another modification of the opposing conductor plate 30.
Figure 31:
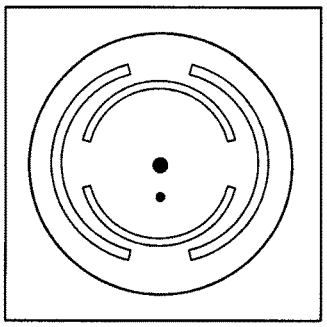
FIG. 31 is a view showing still another modification of the opposing conductor plate 30.

FIG. 28 and FIG. 29 show an arrangement in which two slots to define the second-frequency operation region and two slots to define the third-frequency operation region are aligned on a same straight line passing across the short-circuiting portion 40 as an example. FIG. 30 and FIG. 31 show examples when the slots are arranged in such a manner that a direction in which two slots to define the second-frequency operation region are aligned and a direction in which two slots to define the third-frequency operation region are aligned intersect with each other.

In the configurations shown in FIG. 28 and FIG. 29, the slots for the third frequency are present between the short-circuiting portion 40 and the slots for the second frequency. Hence, a propagation of a vertical electric field heading from the short-circuiting portion 40 toward the slots for the second frequency may be slightly impeded by the slots for the third frequency and a gain at the second frequency may possibly be decreased.

Meanwhile, in the configurations shown in FIG. 30 and FIG. 31, the slots for the third frequency are absent between the short-circuiting portion 40 and the slots for the second frequency. Hence, a risk that the slots for the third frequency impede a propagation of a vertical electric field heading from the short-circuiting portion 40 toward the slots for the second frequency can be reduced.

That is to say, in a case where slots respectively corresponding to three or more target frequencies are provided to the opposing conductor plate 30 in order to transmit and receive radio waves at the respective frequencies, it is preferable to dispose the slots in such a manner that slots for each frequency are not absent between the short-circuiting portion 40 and slots for any other frequency.

(Ninth Modification)

Figure 32:
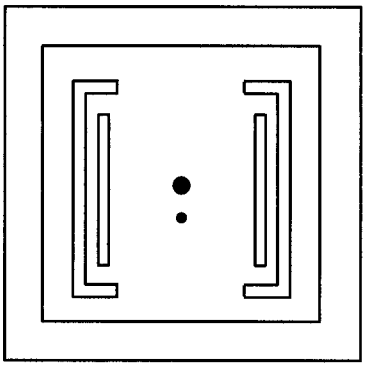
FIG. 32 is a view showing still another modification of the opposing conductor plate 30.
Figure 33:
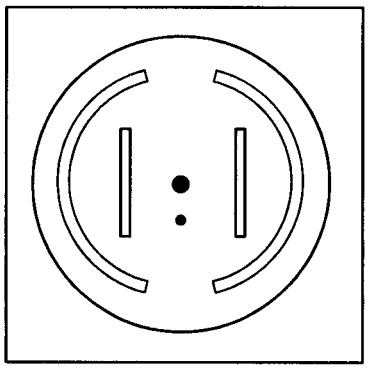
FIG. 33 is a view showing still another modification of the opposing conductor plate 30.

FIG. 32 and FIG. 33 show examples when the configurations of FIG. 28 and FIG. 29 are modified by forming slots for a particular frequency in a linear shape. Even when the configuration is modified as above, the effect described above can be achieved by designing lengths and positions of the slots so as to satisfy the conditions described above.

(Second Embodiment)

Figure 34:
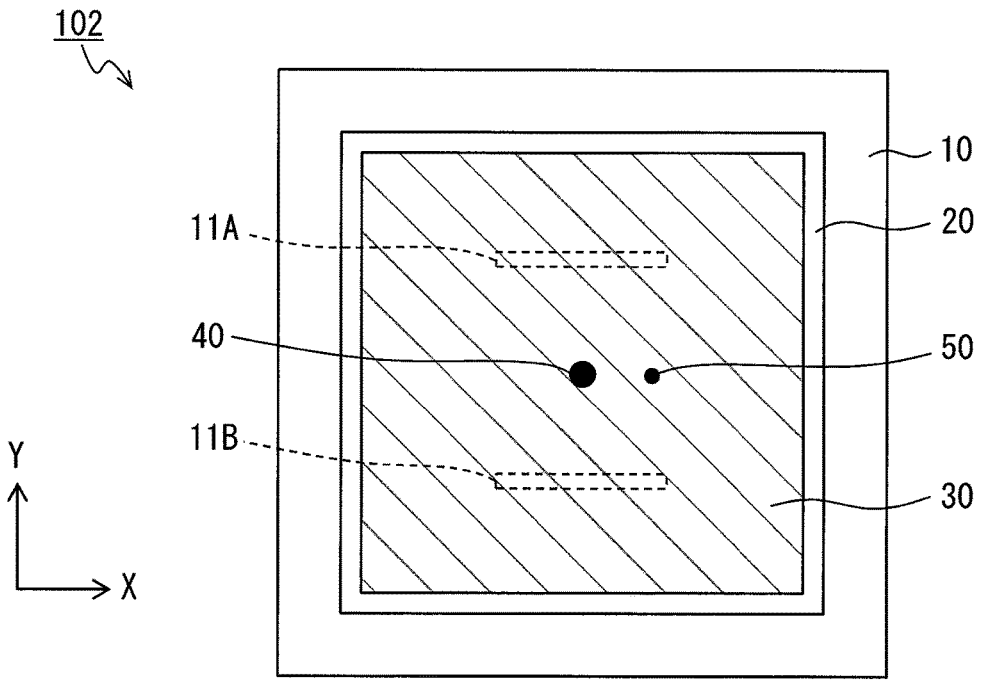
FIG. 34 is a top view of an antenna device 102 according to a second embodiment.
Figure 35:
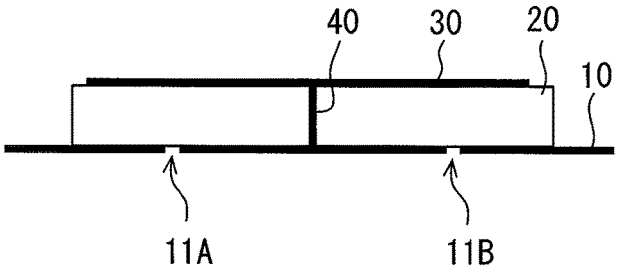
FIG. 35 is a sectional view of the antenna device 102 taken along a straight line parallel to a Y axis and passing across the short-circuiting portion 40.

A second embodiment of the present disclosure will now be described using the drawings. FIG. 34 is a top view of an antenna device 102 of the second embodiment. FIG. 35 is a schematic view showing a cross section of the antenna device 102 shown in FIG. 34 taken along a linear line parallel to a Y axis and passing across the short-circuiting portion 40.

As are shown in FIG. 34 and FIG. 35, in the antenna device 102 of the second embodiment, slots 11A and 11B equivalent to the slots 31A and 31B described in the first embodiment above are provided to the base plate 10 instead of the opposing conductor plate 30. An effect same as the effect of the first embodiment above can be achieved by the configuration as above.

Concepts underlying the first through ninth modifications above can be applied to or combined with the configuration of the second embodiment. In short, multiple slots can be provided to the base plate 10 and a shape of the slots can be changed in various manners.

(Third Embodiment)

A third embodiment according to the present disclosure will now be described. In an antenna device 103 of the third embodiment, a metal plate achieving an effect same as the effect of the slots described in the first embodiment, the second embodiment, and the various modifications above is provided to a layer between the base plate 10 and the opposing conductor plate 30. That is to say, the third embodiment is different from the embodiments and the modifications described above in that a region of the opposing conductor plate 30 inducing an electrostatic capacitance between the opposing conductor plate 30 and the base plate 10 is limited by impeding a propagation of a vertical electric field heading from the short-circuiting portion 40 to an edge portion of the opposing conductor plate 30 using a metal plate provided to a layer between the base plate 10 and the opposing conductor plate 30 instead of providing slots to at least one of the base plate 10 and the opposing conductor plate 30.

The following will describe a configuration of the antenna device 103 of the third embodiment using the drawings. For ease of description, the antenna device 103 described as an example is an antenna device configured to transmit and receive radio waves at two target frequencies, namely a first frequency and a second frequency. That is to say, the metal plate provided between the base plate 10 and the opposing conductor plate 30 is an element additionally provided to enable an antenna device capable of transmitting and receiving radio waves at the first frequency to also transmit and receive radio waves at the second frequency.

Figure 36:
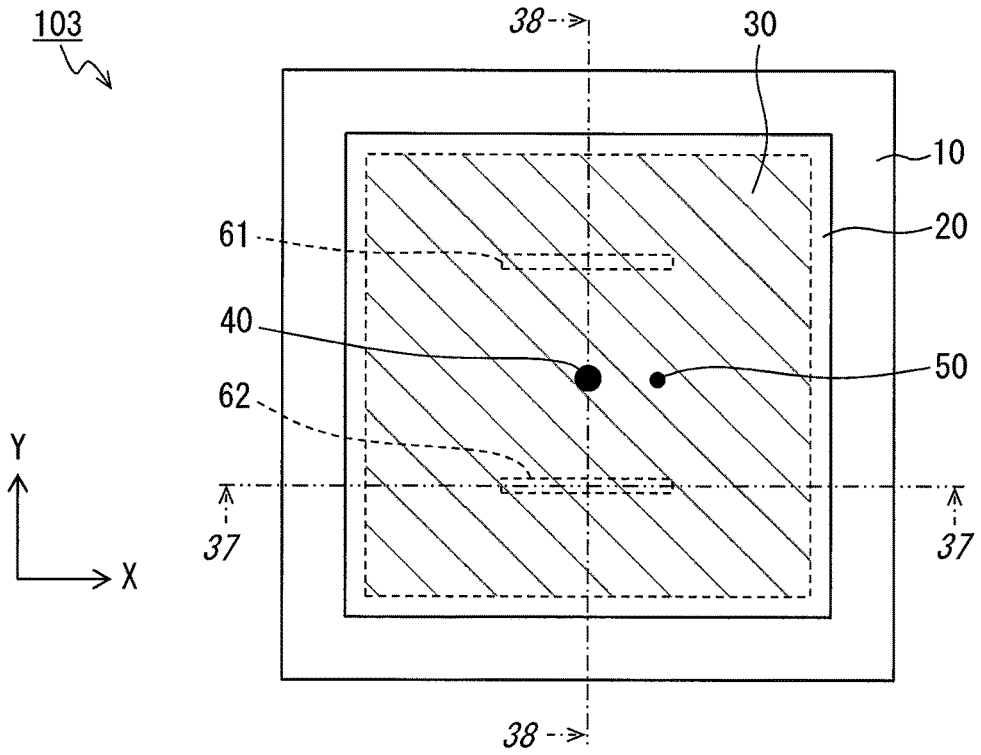
FIG. 36 is a top view of an antenna device 103 according to a third embodiment.
Figure 37:
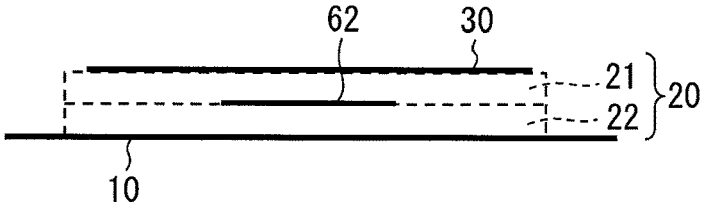
FIG. 37 is a sectional view of the antenna device 103 taken along the line 37-37 of FIG. 36.
Figure 38:
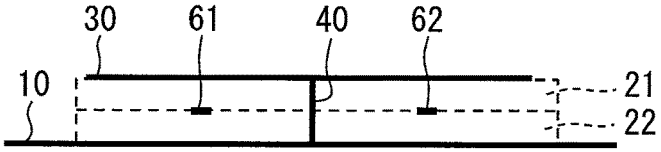
FIG. 38 is another sectional view of the antenna device 103 taken along the line 38-38 of FIG. 36.

FIG. 36 is a top view of the antenna device 103 of the third embodiment. FIG. 37 is a schematic view showing a cross section taken along the line 37-37 of FIG. 36. FIG. 38 is a schematic view of a cross section taken along the line 38-38 of FIG. 36. In order to specify positions of metal plates 61 and 62, which is one of characteristics of the third embodiment, the supporting portion 20 is indicated by a broken line in the schematic views of FIG. 37 and FIG. 38.

As are shown in FIG. 36 through FIG. 38, the antenna device 103 of the present embodiment includes the metal plates 61 and 62 in a linear shape having a predetermined length and disposed at symmetric positions with respect to the short-circuiting portion 40 while aligning a longitudinal direction to be orthogonal to a direction heading from the short-circuiting portion 40 to an edge portion of the opposing conductor plate 30. The metal plates 61 and 62 correspond to a conductor referred to in the appended claims.

A length and a thickness of the metal plates 61 and 62 as well as positions in a direction of an XY plane with respect to the short-circuiting portion 40 and a spaced distance from the opposing conductor plate 30 in a Z-axis direction may be designed as needed so as to achieve an effect same as effect of the slots described above. For example, as with the slots described above, a length of the metal plates 61 and 62 in the longitudinal direction may be adjusted as needed according to a distance from the short-circuiting portion 40 in reference to an electrical length equal to half a second wavelength.

A thickness of the metal plates 61 and 62 may be also designed as needed. It is, however, preferable to design the metal plates 61 and 62 to be thinner because the metal plates 61 and 62 may possibly impede a propagation of a vertical electric field induced at the first frequency when the metal plates 61 and 62 are thick. The disclosing party conducted various tests and confirmed that an effect of impeding a propagation of a vertical electric field induced at the second frequency is reduced by disposing the metal plates 61 and 62 in close proximity to either the base plate 10 or the opposing conductor plate 30. It is therefore preferable to dispose the metal plates 61 and 62 at an intermediate position between the base plate 10 and the opposing conductor plate 30 in a Z-axis direction.

Relative positions of the metal plates 61 and 62 on the XY plane with respect to the short-circuiting portion 40 may be determined in such a manner that the metal plates 61 and 62 adjust an electrostatic capacitance generated by the opposing conductor plate 30 with the base plate 10 to have a value at which the electrostatic capacitance undergoes parallel resonance with inductance of the short-circuiting portion 40.

The antenna device 103 described above may be realized by using, for example, two printed-circuit boards 21 and 22. To be more specific, the antenna device 103 may be realized by disposing the printed-circuit board 22 on the base plate 10 and by laminating the printed-circuit board 21, which is provided with the opposing conductor plate 30 on one surface and the metal plates 61 and 62 on the other surface, on the printed-circuit board 22 in such a manner that the surface of the printed-circuit board 21 where the metal plates 61 and 62 are provided comes into contact with the surface of the printed-circuit board 22 where the base plate 10 is not provided. In such a case, the printed-circuit boards 21 and 22 correspond to the supporting portion 20. Alternatively, the antenna device 103 may be realized by using a single printed-circuit board incorporating the metal plates 61 and 62.

Figure 39:
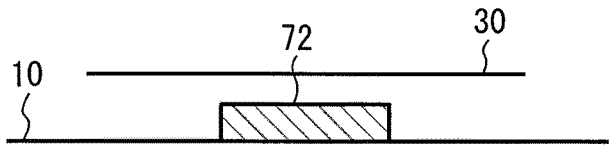
FIG. 39 is a view corresponding to FIG. 37 to show a modification of the third embodiment.
Figure 40:
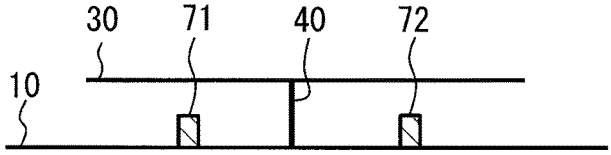
FIG. 40 is a view corresponding to FIG. 38 to show the modification of the third embodiment.

As are shown in FIG. 39 and FIG. 40, metal bodies 71 and 72 connected to the base plate 10 may be used instead of the metal plates 61 and 62 as above. Even when configured in such a manner, a similar effect can be achieved by adjusting a length, a thickness, and a position of the metal body 71 as needed. FIG. 39 corresponds to FIG. 37 and FIG. 40 corresponds to FIG. 38. The supporting portion 20 is omitted in FIG. 39 and FIG. 40.

For example, a length of the metal bodies 71 and 72 in a longitudinal direction may be adjusted as needed according to a distance from the short-circuiting portion 40 in reference to an electrical length equal to half the second wavelength in a same manner as the slots described above. A thickness of the metal bodies 71 and 72 may be also designed as needed. An effect of impeding a propagation of a vertical electric field is increased as the thickness is increased, that is, as a clearance between the metal bodies 71 and 72 and the opposing conductor plate 30 becomes smaller. However, when the thickness is increased exceedingly, the metal bodies 71 and 72 may also impede a propagation of a vertical electric field induced at the first frequency. Hence, it is preferable to set a thickness of the metal bodies 71 and 72 to a value with which the metal bodies 71 and 72 does not impede a propagation of a vertical electric field induced at the first frequency and impedes a propagation of a vertical electric field induced at the second frequency.

Positions of the metal bodies 71 and 72 in the base plate 10 may be determined in such a manner that the metal bodies 71 and 72 adjusts an electrostatic capacitance generated by the opposing conductor plate 30 with the base plate 10 to have a value at which the electrostatic capacitance undergoes parallel resonance with inductance of the short-circuiting portion 40.

Figure 41:
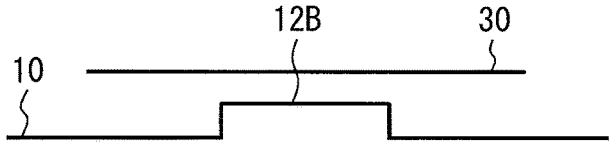
FIG. 41 is a view corresponding to FIG. 39 to show a different modification of the third embodiment.
Figure 42:
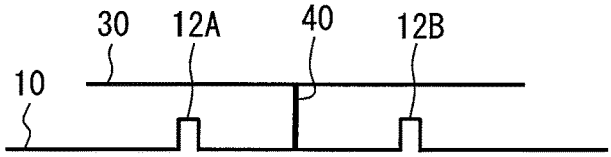
FIG. 42 is a view corresponding to FIG. 40 to show the different modification of the third embodiment.

An effect same as the effect in the examples of FIG. 39 and FIG. 40 may be achieved by replacing the metal bodies 71 and 72 shown in FIGS. 39 and 40 with protrusion portions 12A and 12B shown in FIG. 41 and FIG. 42 which are provided to the base plate 10 by partially raising the base plate 10 to a predetermined height in a direction toward the opposing conductor plate 30. The metal bodies 71 and 72 and the protrusion portions 12A and 12B correspond to a metal pattern referred to in the appended claims.

Concepts underlying the first through ninth modifications above can be also applied to or combined with the configuration of the third embodiment. In short, multiple metal plates can be provided between the opposing conductor plate 30 and the base plate 10 and a shape of the metal plates can be changed in various manners. Further, multiple metal bodies or protrusion portions can be provided to the base plate 10 and shapes of the metal bodies and the protrusion portions can be changed in various manners.

The various slots, the metal plates, the metal bodies, and the protrusion portions described above correspond to an electric-field impeding element referred to in the appended claims. In particular, the slots, the metal plates, the metal bodies, and the protrusion portions to impede movement of a vertical electric field induced at the second frequency correspond to a second-frequency electric-field impeding element referred to in the appended claims. Likewise, the slots, the metal plates, the metal bodies, and the protrusion portions to impede movement of a vertical electric field induced at the third frequency correspond to a third-frequency electric-field impeding element referred to in the appended claims.

The electric-field impeding elements realized in various forms, such as slots and metal plates, may be provided to either the opposing conductor plate 30 or the base plate 10. Further, the electric-field impeding elements may be provided between the opposing conductor plate 30 and the base plate 10.

The electric-field impeding elements realized in various forms may be combined, too. For example, the protrusion portions 12A and 12B to define the second-frequency operation region may be provided to the base plate 10 and the slots 32A and 32B to define the third-frequency operation region may be provided to the opposing conductor plate 30.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. An antenna device, comprising:

a base plate;

an opposing conductor plate that is a conductor member of a flat-plate shape provided parallel to the base plate at a predetermined interval;

a short-circuiting portion provided to a center portion of the opposing conductor plate to electrically connect the opposing conductor plate and the base plate;

a power-feed point electrically connecting the opposing conductor plate and an electrical supply line used to feed power to the opposing conductor plate; and at least one second-frequency electric-field impeding element provided to the opposing conductor plate, the base plate, or between the opposing conductor plate and the base plate, wherein an entire area of the opposing conductor plate is an area of a proper size to generate an electrostatic capacitance that gives rise to parallel resonance with inductance of the short-circuiting portion at a predetermined first frequency, the second-frequency electric-field impeding element impedes a propagation of an electric field, which is vertical to the base plate and heads from the short-circuiting portion toward an outer edge portion of the opposing conductor plate, induced at a second frequency higher than the first frequency and does not impede a propagation of the electric field induced at the first frequency, and the second-frequency electric-field impeding element is disposed so as to make an electrical area of the opposing conductor plate for a signal at the second frequency to be an area of a proper size to generate an electrostatic capacitance that undergoes parallel resonance with the inductance of the short-circuiting portion at the second frequency.

2. The antenna device according to claim 1, wherein two second-frequency electric-field impeding elements are provided at positions symmetrical to each other with respect to the short-circuiting portion.

3. The antenna device according to claim 1, further comprising:

at least one third-frequency electric-field impeding element provided to the opposing conductor plate, the base plate, or between the opposing conductor plate and the base plate, wherein the third-frequency electric-field impeding element impedes a propagation of the electric field induced at a third frequency higher than the second frequency and does not impede a propagation of the electric field induced at the first frequency and the electric field induced the second frequency, and the third-frequency electric-field impeding element is disposed so as to make an electrical area of the opposing conductor plate for a signal at the third frequency to be an area of a proper size to generate an electrostatic capacitance that undergoes parallel resonance with the inductance of the short-circuiting portion at the third frequency.

4. The antenna device according to claim 3, wherein two third-frequency electric-field impeding elements are provided at positions symmetrical to each other with respect to the short-circuiting portion.

5. The antenna device according to claim 4, wherein the second-frequency electric-field impeding element is not provided between the third-frequency electric-field impeding elements and the short-circuiting portion.

6. The antenna device according to claim 5, wherein the third-frequency electric-field impeding elements are provided between the second-frequency electric-field impeding element and the short-circuiting portion.

7. The antenna device according to claim 5, wherein the antenna device at least transmits or receives radio waves at a plurality of target frequencies including at least three frequencies that are the first frequency, the second frequency, and the third frequency, the first frequency is a lowest frequency among the plurality of target frequencies, a plurality of electric-field impeding elements are provided and at least one electric-field impeding element is provided for each of the plurality of target frequencies except for the first frequency and each electric-field impeding element impedes a propagation of the electric field induced at the target frequency and does not impede a propagation of the electric field induced at any other frequency in the plurality of target frequencies, and each electric-field impeding element is disposed so as to make an electrical area of the opposing conductor plate for a signal at the target frequency of the electric-field impeding element to be an area of a proper size to generate an electrostatic capacitance that undergoes parallel resonance with the inductance of the short-circuiting portion.

8. The antenna device according to claim 7, wherein at least one of the plurality of electric-field impeding elements is a slot provided to the opposing conductor plate or the base plate, and the slot has a length with which the slot resonates at the target frequency, and includes a component orthogonal to a direction heading from the short-circuiting portion toward the outer edge portion of the opposing conductor plate.

9. The antenna device according to claim 7, wherein at least one of the plurality of electric-field impeding elements is provided between the opposing conductor plate and the base plate.

10. The antenna device according to claim 7, wherein at least one of the plurality of electric-field impeding elements is a metal pattern that is provided to the base plate and adjusts an interval between the opposing conductor plate and the base plate.

* * * * *